US006224122B1

(12) United States Patent
Glenn

(10) Patent No.: US 6,224,122 B1
(45) Date of Patent: May 1, 2001

(54) HIGH PRESSURE RUBBER BALE HANDING CLAMP

(75) Inventor: James R. Glenn, Lumberton, TX (US)

(73) Assignee: Sage Automation, Inc., Beaumont, TX (US)

( * ) Notice: Subject to any disclaimer, the term of this patent is extended or adjusted under 35 U.S.C. 154(b) by 0 days.

(21) Appl. No.: 09/298,280

(22) Filed: Apr. 23, 1999

(51) Int. Cl.[7] ..... B66C 1/58
(52) U.S. Cl. ..... 294/88; 294/106; 901/37
(58) Field of Search ..... 294/88, 106, 67.31, 294/81.51, 81.61, 115; 414/738, 739; 901/37

(56) References Cited

U.S. PATENT DOCUMENTS

| | | | | |
|---|---|---|---|---|
| 3,410,431 | * | 11/1968 | Vik | 294/88 |
| 3,631,989 | * | 1/1972 | McCormick | 901/37 |
| 4,090,628 | * | 5/1978 | Sinclair | 294/88 |
| 4,304,433 | * | 12/1981 | Langowski | 294/88 |
| 4,728,137 | * | 3/1988 | Hamed et al. | 901/37 |
| 5,028,085 | * | 7/1991 | Dudley, Jr. | 294/88 |
| 5,516,255 | * | 5/1996 | Tygard | 294/81.61 |
| 5,588,794 | * | 12/1996 | Panyard | 901/37 |
| 5,890,754 | * | 4/1999 | Murr | 294/88 |
| 6,056,341 | * | 5/2000 | Bliss | 294/106 |

OTHER PUBLICATIONS

Page from PH Fluid Power, No Date.
Sage Automation, Inc. Advertisement, No Date.

* cited by examiner

*Primary Examiner*—Dean J. Kramer
(74) *Attorney, Agent, or Firm*—Fulbright & Jaworski

(57) ABSTRACT

A variable leverage mechanism for variably leveraging the force of a piston and cylinder assembly in a high-pressure rubber bale clamp. The device may include a toggle or cam or other suitable variable leverage mechanism. The device compresses rubber bales immediately after manufacture so as to facilitate packaging and transport.

8 Claims, 5 Drawing Sheets

HIGH PRESSURE RUBBER BALE HANDING CLAMP

SPECIFICATION

1. Field of the Invention

The invention is in the field of clamps for handling bales of rubber.

2. Background of the Invention

Raw rubber is a unique product that requires specialized equipment for handling and packaging. Raw rubber is manufactured in bales, which are sized for placement in shipping containers. As a bale of such rubber sits in an unconfined space, it cold flows, becoming wider and shorter. Such bales must be individually wrapped with plastic so that, when the bales are placed together in containers for shipping, they do not cold flow and merge with each other. Further, because cold flow is a constant process, the bales, before wrapping or packaging, must be re-compressed to their desired shipping dimensions.

In the prior art, a bale is handled with a pneumatic handling clamp that includes a plurality of paddles. The paddles are hinged from a frame, and assemblies of pneumatic pistons and cylinders actuate the paddles, placing the paddles in contact with each side of the bale. In such manner, the handling clamp grasps the bale. The handling clamp is attached to a robotic arm, facilitating lifting and moving of the bale. When the bale has been placed by the handling clamp in a desired location, the paddles are opened, releasing the bale.

Prior art handling clamps exhibit a simple lever mechanism connecting the piston and cylinder assembly to the paddles. The problem with the handling clamps of the prior art is that they have limited clamping force due to mechanical disadvantage. As a result, while prior art handling clamps are adequate to lift and move bales, they fail to generate force sufficient to compress the bales. The apparent solution to this problem is to increase the size of the pneumatic piston and cylinder assemblies of the handling clamps. However, practical considerations limit the size of handling clamps, and factories manufacturing rubber typically utilize only "shop air," or air compressed at about 80–120 psi, to drive its wide variety of equipment, including handling clamps. Thus, pneumatic piston and cylinder size requirements using "shop air" as a driving force makes such a solution impractical.

To compensate for the foregoing inadequacy in the compression of prior art handling clamps, the prior art teaches the use of a separate, high-compression, fixed clamp, to which a conveyor transports a bale for compression immediately after manufacture and immediately before packaging. After compression by the fixed clamp, the handling clamp grasps the bale and moves it for packaging. The disadvantages of this dual clamp packaging method include increased machinery costs, delays in packaging, need to package immediately after manufacture, and increased mechanical complexity.

SUMMARY OF THE INVENTION

The apparatus of the present invention includes a variable-leverage mechanism connection between the piston and cylinder assemblies and the paddles. The mechanism may be a toggle or a cam any other suitable variable leverage mechanism.

There is provided in this disclosure a high pressure clamp for handling bales of rubber comprising a frame; a connection point for connecting the frame to a robotic arm; a plurality of paddles, the paddles including arms, and hinges moveably connected to the arms; a plurality of piston and cylinder assembles; and a variable leverage connection connecting the arms and assembles. The variable leverage connection may be a toggle arm. The piston and cylinder assembly may be pneumatic. The pneumatic piston and cylinder assembly may have an operating pressure between 80 and 120 psi.

There is also provided in this disclosure a method of providing high-pressure clamping force in a clamp for handling bales of rubber, the clamp comprising a piston and cylinder assembly and a paddle, the method comprising the steps of actuating the piston and cylinder assembly; applying a force from the actuating piston and cylinder assembly to the paddle; and variably leveraging the force between the actuating piston and cylinder assembly and the paddle during a stroke of the piston and cylinder assembly.

There is also provided in this disclosure, a method of compressing and lifting a bale of rubber comprising the steps of surrounding a bale of rubber with paddles; actuating a plurality of pistons whereby a mechanical displacement is effected; variably leveraging the mechanical displacement; and applying the mechanical displacement to an arm of the paddles.

DETAILED DESCRIPTION OF THE PREFERRED EMBODIMENT

Figure 1:
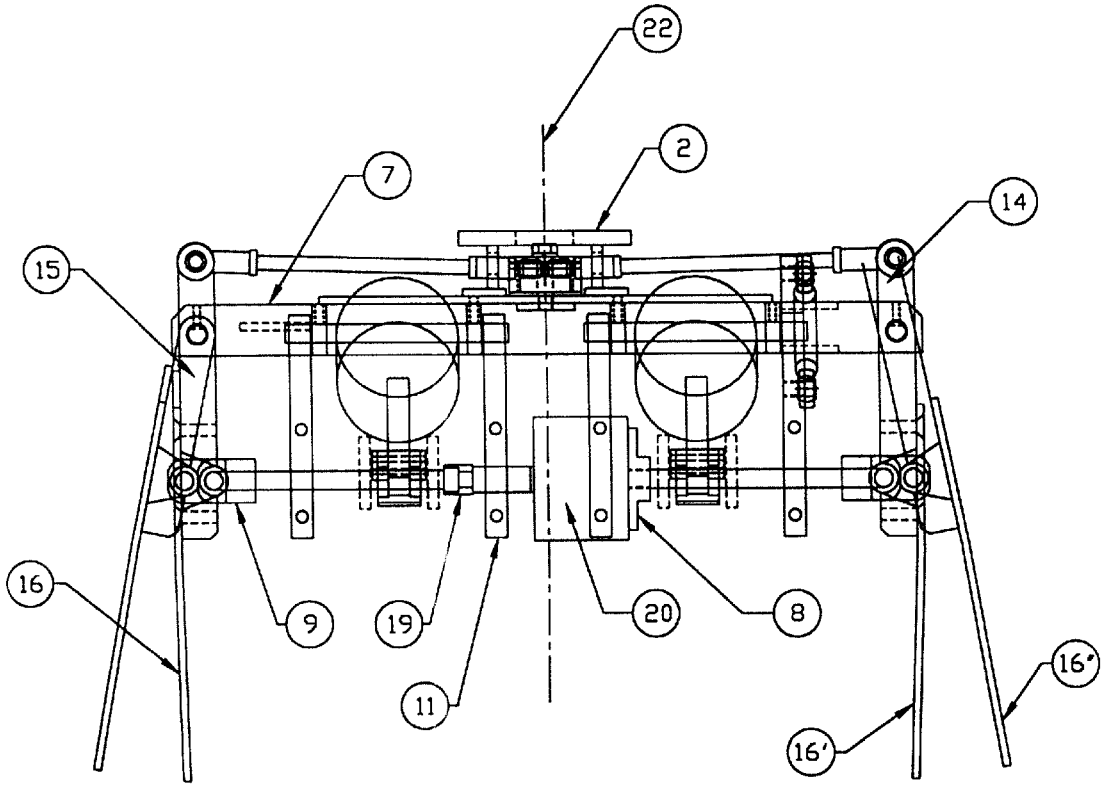
FIG. 1 is a longitudinal side view of a handling clamp illustrative of the invention.

FIG. 1 depicts a side longitudinal view of a handling clamp 22 illustrative of the present invention. The handling clamp 22 includes an end-effector-to-u-axis mount 2, frame 7, a cylinder mounting plate 8, end paddle connecting eye 9, clamp arm hinge 11, end paddle synchronizing arm 14, end paddle arm hinge 15, end paddle 16, cylinder rod connecting plate 19, and first piston and cylinder assembly 20. The end paddle 16 is depicted in closed position 16' and open position 16".

Figure 2:
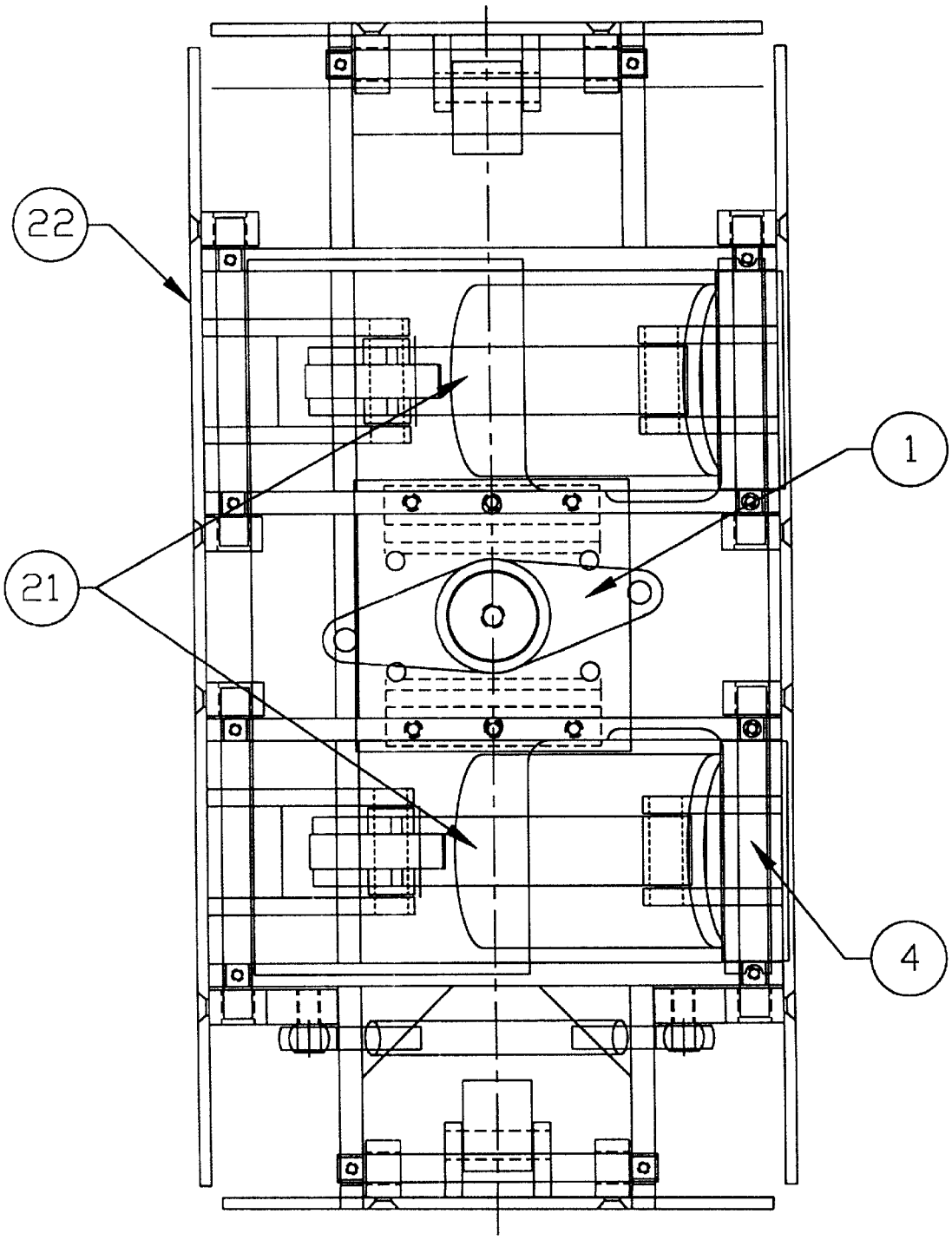
FIG. 2 is a top view of the handling clamp of FIG. 1.

FIG. 2 depicts a top view of handling clamp 22, including end clamp synchronizing bell crank 1, cylinder mount 4, and second piston and cylinder assembly 21.

Figure 3:
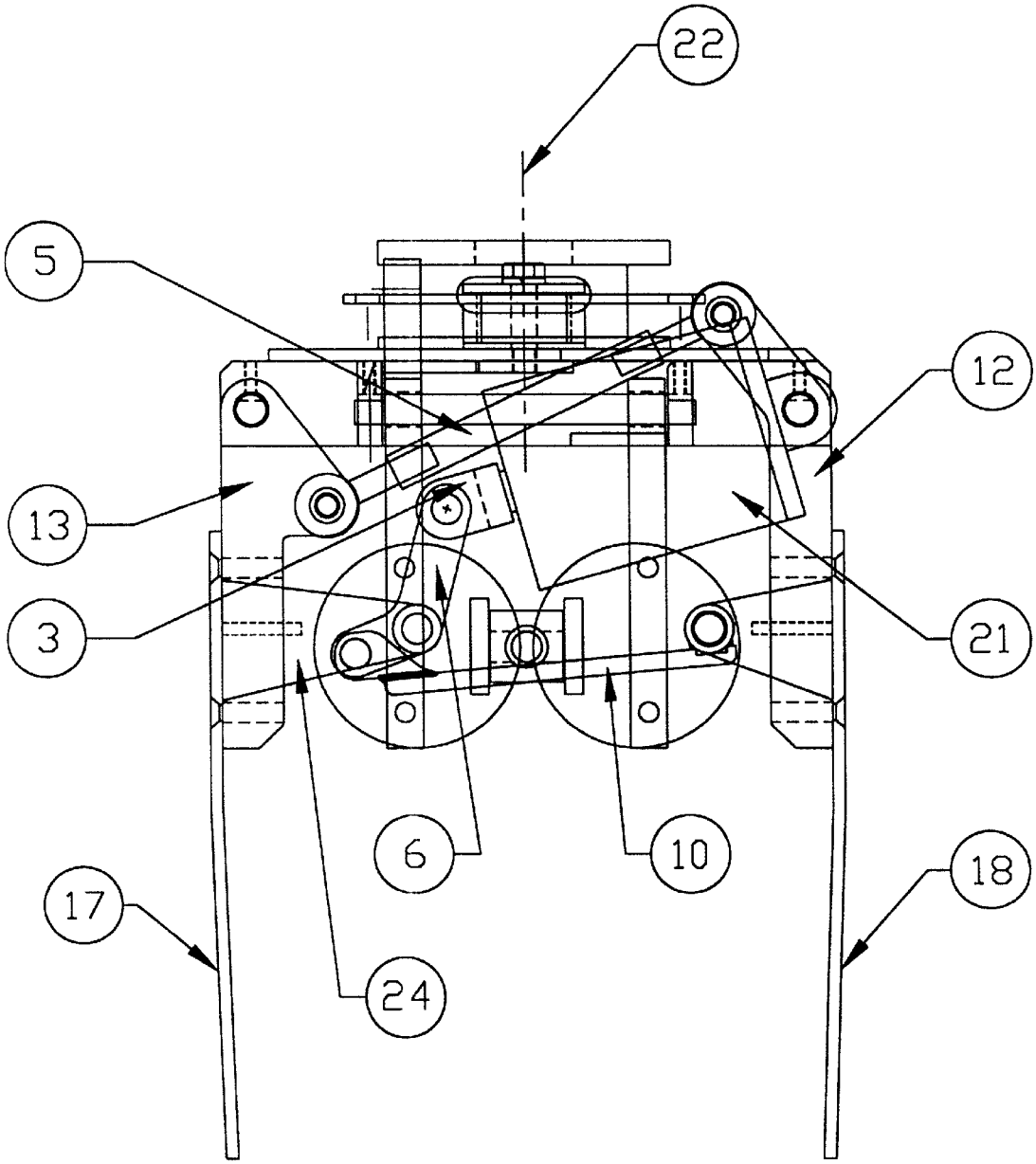
FIG. 3 is a lateral view of the handling clamp of FIG. 1.

FIG. 3 depicts a end lateral view of handling clamp 22, including clevis 3, side paddle synchronizing link 5, long synchronizing arm 12, short synchronizing arm 13, first side paddle 17, second side paddle 18, toggle arm 6, side paddle toggle 10, second piston and cylinder assembly 21, and paddle bracket 24.

Figure 4:
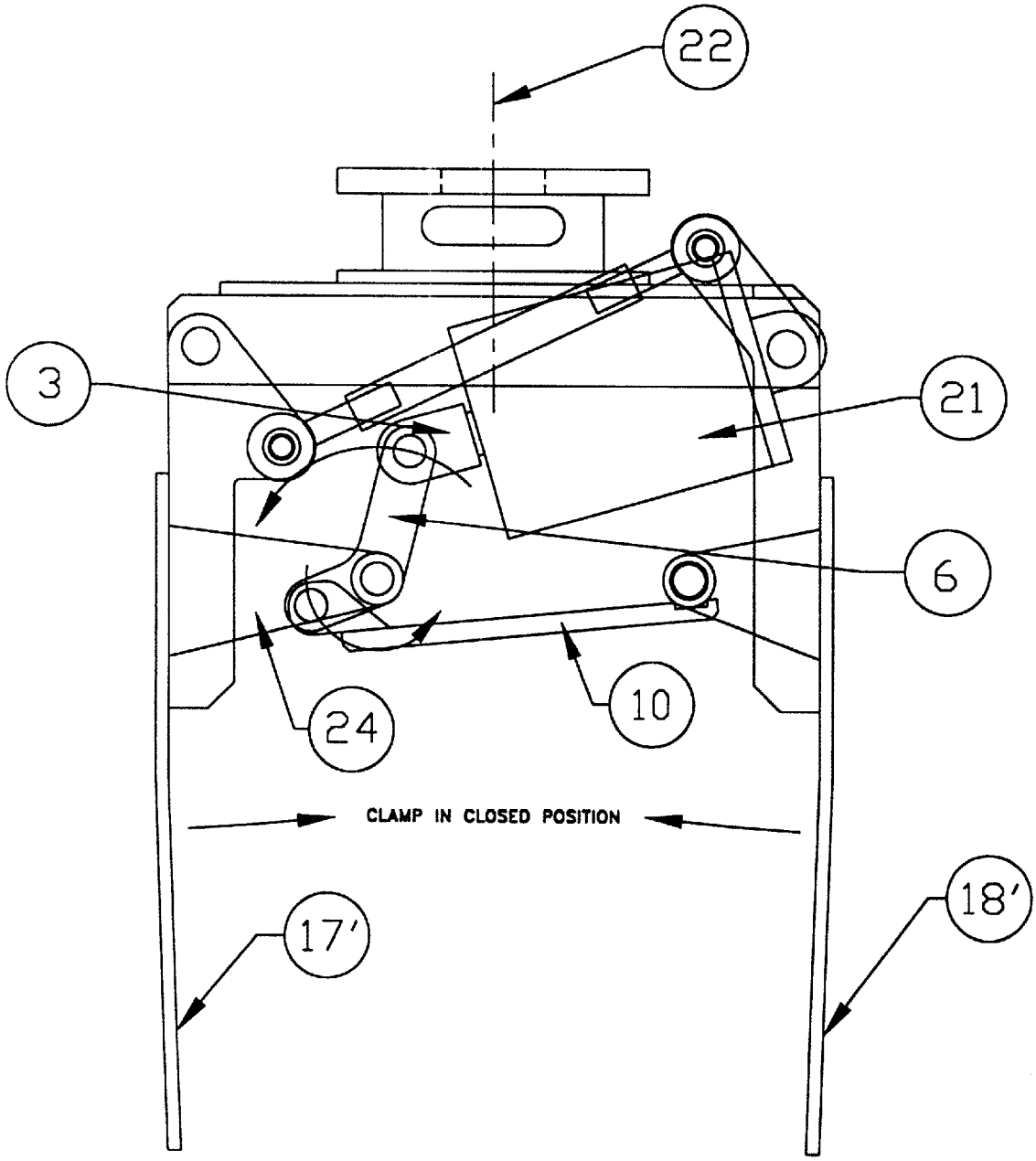
FIG. 4 is a partial side view of a handling clamp of FIG. 1 with paddles closed.
Figure 5:
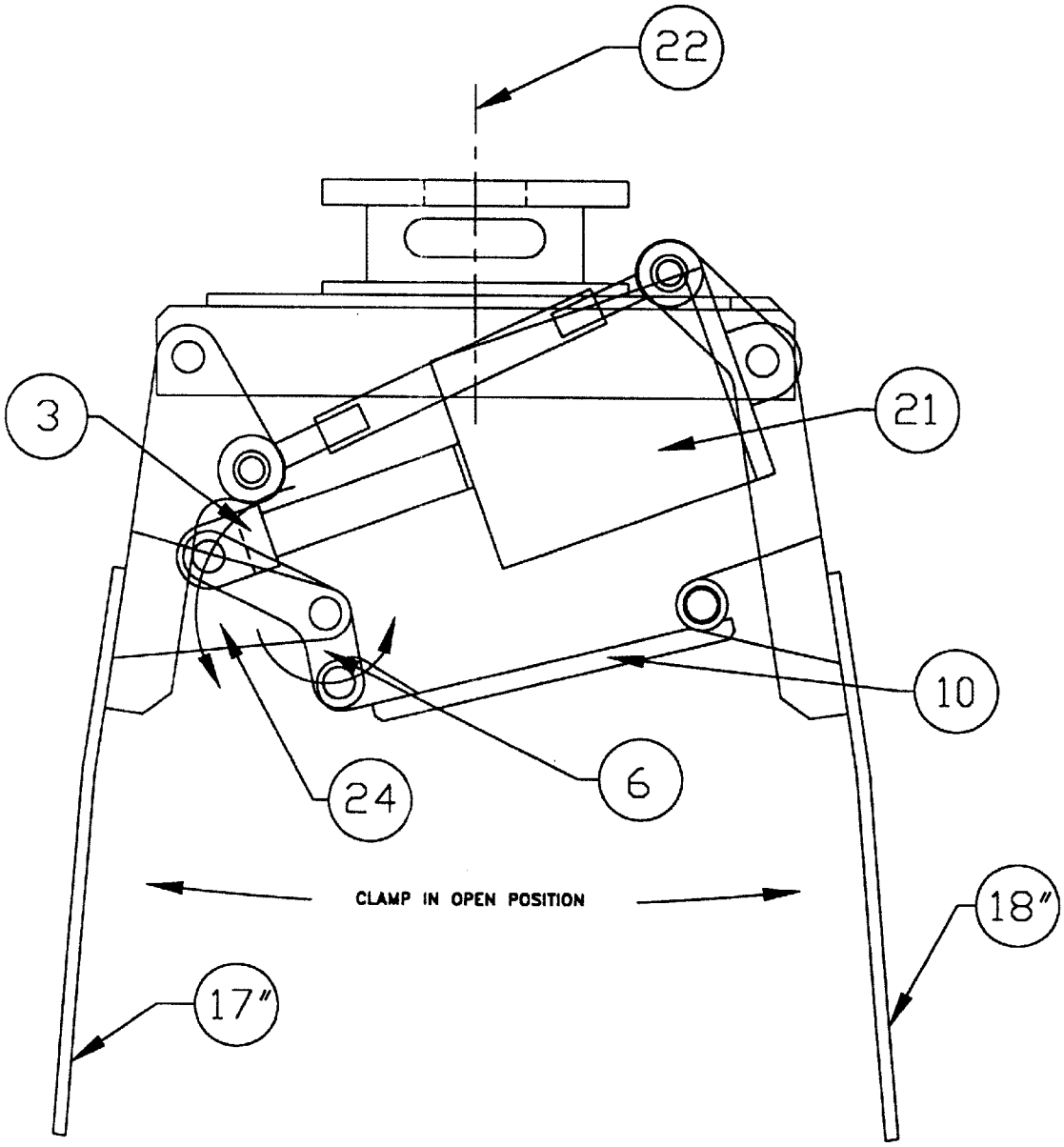
FIG. 5 is a partial side view of a handling clamp of FIG. 1 with paddles open.

FIG. 4 depicts a partial side longitudinal view of handling clamp 22 with paddles 17' and 18' in a closed position, more particularly depicting certain illustrative features of the invention. FIG. 5 depicts handling clamp 22 with paddles 17" and 18" in an open position.

Referring to FIGS. 4 and 5, as handling clamp 22 closes its paddles 17 and 18, the location of toggle arm 6 in the connection of piston and cylinder assembly 21 and paddle bracket 24 causes the leveraged exercised by the piston and cylinder assembly 21 and the bracket 24 to vary throughout the stroke of the piston and cylinder assembly. The stroke of the piston and cylinder assembly 21 exercises relatively little leverage on the paddles 17 and 18 as they approach open positions 17" and 18". However, the stroke of the piston and cylinder assembly 21 exercises relatively large leverage on the paddles 17 and 18 as they approach closed positions 17' and 18'. Thus, the paddles 17 and 18 move over a wide range relative to piston stroke while the paddles 17 and 18 are not grasping a bale, but the paddles 17 and 18 move over a short range, but with great force, while the paddles 17 and 18 are grasping a bale. Using such a variable leverage connecting mechanism enables paddles 17 and 18 to be driven by standard sized, 80–120 psi pneumatic piston and cylinder assemblies of the type typically used in the prior art, but also provides sufficient force to compress cold-flowing bales of rubber.

With the benefit of this disclosure, one of ordinary skill in the art of manufacturing rubber bale handling apparatus will appreciate that a wide variety of variable leverage connectors may be used within the scope of the present invention, including without limitation, toggles and cams.

What is claimed is:

1. A high pressure clamp for handling bales of rubber comprising:

a frame;

a connection point for connecting the frame to a robotic arm;

a plurality of paddles, the paddles including arms and hinges moveably connected to the arms;

a plurality of piston and cylinder assembles; and a variable leverage connection connecting the arms and assemblies, the variable leverage connection located between the paddles and exhibiting increased leverage as the paddles are closed.

2. The clamp apparatus of claim 1 in which the variable leverage connection is a toggle arm.

3. The clamp apparatus of claim 2 in which the piston and cylinder assembly is pneumatic.

4. The clamp apparatus of claim 3 in which the pneumatic piston and cylinder assembly has an operating pressure between 80 and 120 psi.

5. The clamp apparatus of claim 1 in which the piston and cylinder assembly is pneumatic.

6. The clamp apparatus of claim 5 in which the pneumatic piston and cylinder assembly has an operating pressure between 80 and 120 psi.

7. A method of providing high-pressure clamping force in a clamp for handling bales of rubber, the clamp comprising a piston and cylinder assembly and a paddle, the method comprising the steps of:

actuating the piston and cylinder assembly, applying a force from the actuating piston and cylinder assembly to the paddle; and increasing a leverage of the force between the actuating piston and cylinder assembly and the paddle during a closure of the paddle.

8. A method of compressing and lifting a bale of rubber comprising the steps of:

placing opposing paddles about a bale of rubber;

actuating a piston in communication with a first paddle whereby a mechanical displacement of the paddle is effected; and increasing leverage of the mechanical displacement as the first paddle is biased against the bale of rubber, whereby the bale of rubber is compressed.

* * * * *